US007918446B2

(12) United States Patent
Yanagishita

(10) Patent No.: US 7,918,446 B2
(45) Date of Patent: Apr. 5, 2011

(54) FEEDING DEVICE AND RECORDING APPARATUS

(75) Inventor: Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 10 days.

(21) Appl. No.: 12/467,380

(22) Filed: May 18, 2009

(65) Prior Publication Data

US 2009/0283956 A1 Nov. 19, 2009

(30) Foreign Application Priority Data

May 19, 2008 (JP) ..... 2008-131024

(51) Int. Cl.
*B65H 3/32* (2006.01)

(52) U.S. Cl. ..... 271/121; 271/122; 271/124

(58) Field of Classification Search ..... 271/121, 271/125, 117, 272, 273, 264, 4.1, 10.11, 271/10.12, 225, 245, 122, 124
See application file for complete search history.

(56) References Cited

U.S. PATENT DOCUMENTS 6,059,281 A * 5/2000 Nakamura et al. ..... 271/119
6,536,759 B1 * 3/2003 Takada ..... 271/125
7,104,539 B2 * 9/2006 Shimoyama ..... 271/167
7,267,334 B2 * 9/2007 Koh et al. ..... 271/121
7,364,156 B2 * 4/2008 Wanibuchi et al. ..... 271/264
7,484,725 B2 * 2/2009 Ueda et al. ..... 271/121
7,500,666 B2 * 3/2009 Yanagishita ..... 271/121
7,720,429 B2 * 5/2010 Lim ..... 399/388
2003/0085506 A1 * 5/2003 Kubo ..... 271/117
2006/0071400 A1 * 4/2006 Johnson et al. ..... 271/121
2006/0071401 A1 * 4/2006 Chikumoto ..... 271/121
2006/0082050 A1 * 4/2006 Wanibuchi et al. ..... 271/264
2007/0132172 A1 * 6/2007 Mo ..... 271/121
2009/0026693 A1 * 1/2009 Lim ..... 271/121
2009/0166963 A1 * 7/2009 Fukasawa ..... 271/264
2009/0166965 A1 * 7/2009 Fukasawa ..... 271/265.03
2010/0025921 A1 * 2/2010 Kobayashi ..... 271/121

FOREIGN PATENT DOCUMENTS

JP 2007-203707 8/2007

* cited by examiner

*Primary Examiner* — Kaitlin S Joerger
(74) *Attorney, Agent, or Firm* — Workman Nydegger

(57) ABSTRACT

There is provided a feeding device including a pickup roller for picking up a placed medium to be transported and transporting the medium at a downstream side in a transport direction, a guide pathway for guiding the medium transported by the pickup roller, a transport driving roller that is driven by a power of a driving source and that transports the transported medium at the further downstream side in the transport direction, a retard roller that is moved to be brought into contact with and separated from the transport driving roller and that is rotated with a predetermined load.

7 Claims, 10 Drawing Sheets

FEEDING DEVICE AND RECORDING APPARATUS

BACKGROUND

1. Technical Field

The present invention relates to a feeding device equipped with a pickup roller for picking up a placed medium to be transported and feeding the medium at a downstream side in a transport direction, a guide pathway for guiding the medium transported by the pickup roller, a transport driving roller that is driven by a power of a driving source and that transports the transported medium at the further downstream side in the transport direction, and a retard roller that is moved to be brought into contact with and separated from the transport driving roller and that is rotated with a predetermined load, and a recording apparatus equipped with the same.

In the invention, the recording apparatus shall include various apparatuses such as an ink jet printer, a wire dot printer, a laser printer, a line printer, a multifunction apparatus, a facsimile, and the like.

2. Related Art

As disclosed in JP-A-2007-203707, a conventional feeding device provided in a recording apparatus is equipped with a pickup roller, a guide pathway, a transport driving roller, and a retard roller. The pickup roller is provided so that a placed medium to be transported can be picked up and transported at a downstream side in a transport direction. The guide pathway is provided so that the medium transported by the pickup roller can be guided. The transport driving roller is driven by a power of a driving source, and is provided so that the transported medium is transported at the further downstream side in the transport direction. The retard roller is moved to be brought into contact with and separated from the transport driving roller and is rotated with a predetermined load.

FIG. 10 is a side view showing an outline in a recording apparatus according to a conventional technique. As shown in FIG. 10, a feeding device 201 provided in a conventional recording apparatus 200 is equipped with a pickup roller 202, a guide pathway 206, a transport driving roller 205, and a retard roller 204 that can be moved to be brought into contact with and separated from the transport driving roller 205. The pickup roller 202 can pickup a placed paper which is an example of a medium to be transported and transport the paper at a downstream side in a transport direction. Then, the transported paper first enters a bank separation unit 203 as a sub separation unit. Then the paper passed through the bank separation unit 203 is further transported at the downstream side in the transport direction by the retard roller 204 and transport driving roller 205 as a main separation unit. At this time, the retard roller 204 is configured to rotate with a predetermined load.

Consequently, when a plurality of papers are transported to the retard roller 204, only the topmost paper 209 with respect to the transport driving roller 205 can path through the retard roller 204. The operation is called as a retard separation. Then, the topmost paper 209 is transported to a pair of transport rollers 207 provided at the further downstream side in the transport direction by the transport driving roller 205. Then, the topmost paper 209 is transported to a recording unit 208 by the pair of the transport rollers 207.

Herein, after the topmost paper 209 is nipped by the pair of transport rollers 207, the retard roller 204 is retracted from the transport driving roller 205. Accordingly, so called back tension cased by the load of the retard roller 204 can be reduced when transporting the paper.

However, a tip side of a paper 210 separated by the retard separation is made contact with a rear end side of a topmost paper 209 being transported. Accordingly, there is a risk that so called dragging feeding occurs in which the paper 210 separated by the retard separation is dragged by the topmost paper 209 by a friction force with the topmost paper 209 to be transported at the downstream side. That is, if there is no return lever for returning the separated paper 210 at the upstream side in the transport direction used in the conventional technique, a countermeasure for preventing the dragging feeding becomes insufficient.

SUMMARY

An advantage of some aspects of the invention is to provide a feeding device which makes it possible to prevent dragging feeding without providing a return lever and a recording apparatus equipped with the same.

According to an aspect of the invention, there is provided a feeding device including a pickup roller for picking up a placed medium to be transported and transporting the medium at a downstream side in a transport direction, a guide pathway for guiding the medium transported by the pickup roller, a transport driving roller that is driven by a power of a driving source and that transports the transported medium at the further downstream side in the transport direction, a retard roller that is moved to be brought into contact with and separated from the transport driving roller and that is rotated with a predetermined load, a transported medium tip regulation convex provided at a side at which the retard roller is provided in the guide pathway and at the downstream side of a nip point between the retard roller and the transport driving roller in the transport direction, and a control unit for moving the retard roller to separate from the transport driving roller after mediums doubly fed are separated by the retard roller, displacing a tip of the separated medium which is an end of the separated medium at the downstream side in the transport direction, and regulating that the tip of the separated medium is moved at the downstream side in the transport direction by the transported medium tip regulation convex.

According to the aspect of the invention, the feeding device is equipped with the transported medium tip regulation convex and the control unit. Accordingly, after the doubly fed mediums are separated by the retard roller, the tip of the separated medium which is the end of the separated medium at the downstream side in the transport direction can be displaced in the direction to separate from the transport driving roller by moving the retard roller to separate from the transport driving roller. Herewith, it can be regulated that the tip of the separated medium is moved at the downstream side in the transport direction by the transported medium tip regulation convex.

As a result, after the separation performed by the retard roller, so called dragging feeding in which the rear end side of the preceding medium is made contact with the tip side of the following medium and the following medium is dragged to be transported by the preceding paper by a friction force can be prevented. That is, the dragging feeding can be surely prevented without providing so called a return lever conventionally provided for returning the medium separated by the retard roller at the upstream side in the transport direction. Herewith, the feeding device can be downsized and the cost thereof can be reduced by the size and cost of the return lever mechanism. The feeding device is especially available for a large sized medium that often causes the dragging feeding.

Further, since there is no return lever, there is no risk that a damage caused by the return lever is generated on the surface of the medium.

It is preferable that a transport pathway from the placed medium to the nip point between the retard roller and the transport driving roller is bent in side view to form a convex at the side at which the retard roller is provided, the pickup roller is provided to move to be brought into contact with and separated from the placed medium, and the control unit moves the pickup roller in a direction to separate from the medium when the retard roller is moved to separate from the transport driving roller in the feeding device according to the aspect of the invention.

According to the preferred aspect of the invention, besides the effects similar to the first aspect, the transport pathway from the placed medium to the nip point between the retard roller and the transport driving roller is bent in side view to form a convex at the side at which the retard roller is provided. Further, the pickup roller is provided to move to be brought into contact with and separated from the placed medium, and the control unit moves the pickup roller in a direction to separate from the medium when the retard roller is moved to separate from the transport driving roller. Accordingly, deflection of the medium separated by the retard roller can be reduced as compared with the case when the pickup roller is not moved in the direction to be separated.

As a result, the tip of the medium separated by the retard roller can be actively oriented at the side at which the retard roller is provided. Then, the tip of the separated medium can be actively struck at the transported medium tip regulation convex. That is, the dragging feeding can be surely prevented.

Further, the friction force between the preceding medium being fed and the separated following medium can be reduced. Accordingly, the dragging feeding can be further surely prevented.

It is preferable that the guide pathway includes a contact prevention portion for preventing that the medium is made contact with the transport driving roller at a side at which the transport driving roller is provided and at an upstream side of the nip point in the transport direction in the feeding device according to the aspect of the invention.

According to the preferred aspect of the invention, besides the effects similar to the aspect of the invention, the guide pathway includes the contact prevention portion for preventing that the medium is made contact with the transport driving roller at the side at which the transport driving roller is provided and at the upstream side of the nip point in the transport direction. Accordingly, it can be prevented that the following medium separated by the retard roller is made contact with the transport driving roller. To be more specific, it can be prevented that the separated following medium is made contact with the transport driving roller to generate a feeding force when the rear end of the preceding paper being fed is passed through the nip pint. As a result, double feed of mediums can be prevented.

It is preferable that the transported medium tip regulation convex is provided at the both sides of the retard roller in a width direction of the medium in the feeding device according to the aspect of the invention.

According to the preferred aspect of the invention, besides the effects similar to the aspect of the invention, the transported medium tip regulation convex is provided at the both sides of the retard roller in the width direction of the medium. That is, the separated following medium is made contact with the transported medium tip regulation convex at the two portion of the both side. Accordingly, the posture of the tip of the separated following medium can be stabilized in the width direction. That is, there is no risk that the medium inclines with respect to the feeding direction.

Further, by providing the transported medium tip regulation convex near the both sides of the retard roller, when the retard roller is moved to come close to the transport driving roller to perform the retard separation, there is no risk that the tip of the preceding topmost medium with respect to the transport driving roller is hanged up by the transported medium tip regulation convex. That is, the accuracy of retard separation performed by the retard roller can be stabilized.

It is preferable that the guide pathway has a U character shape in the feeding device according to the aspect of the invention.

According to the preferred aspect of the invention, besides the effects similar to the aspect of the invention, the guide pathway has a U character shape. In this case, there is a tendency that a friction force generated between the preceding medium and the following medium becomes large due to the deflection of the preceding medium. Accordingly, the transported medium tip regulation rib is especially available.

It is preferable that the size of the medium is not less than A3 size in the feeding device according to the aspect of the invention.

According to the preferred aspect of the invention, besides the effect similar to the aspect of the invention, the size of the medium is not less than A3 size. In this case, there is a tendency that the contact area between the preceding medium and the following medium becomes large. Consequently, there is a tendency that the friction force generated between the preceding medium and the following medium becomes large. Accordingly, the transported medium tip regulation rib is especially available.

According to another aspect of the invention, there is provided a recording apparatus including a feed unit for picking up a placed recording medium to be recorded and feeding the medium, a transport unit for transporting the fed recording medium at a downstream side in a transport direction, and a recording unit for recording the transported recording medium by a recording head. The feed unit is equipped with the feeding device according to the aspect of the invention.

According to the aspect of the invention, the feed unit is equipped with the feeding device according to the aspect of the invention. Accordingly, the effects similar to the aspect of the invention can be obtained with the recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings.

Figure 1:
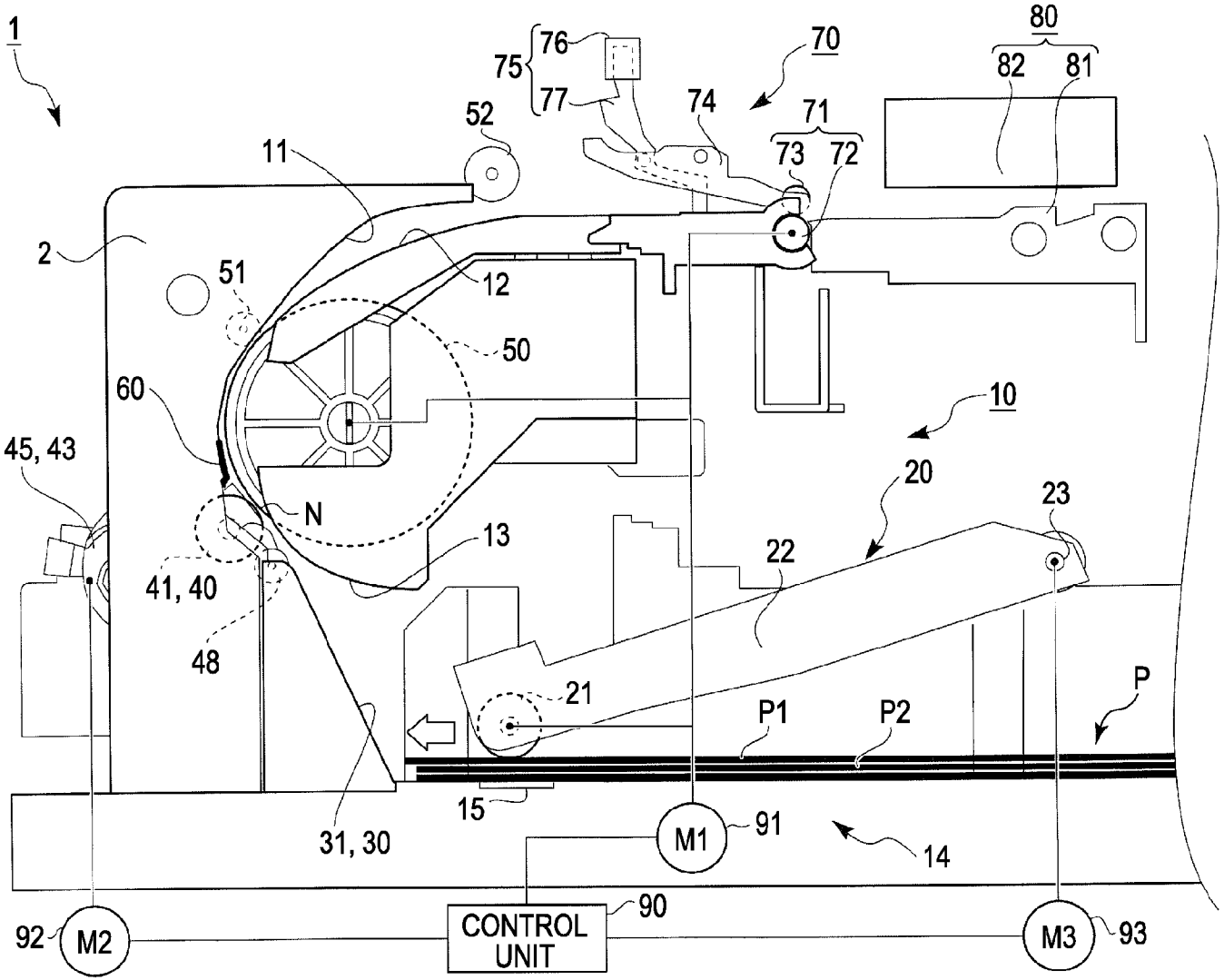
FIG. 1 is a side view showing a pick up operation in a printer according to the invention.

FIG. 1 is a side view showing a picking up operation in an ink jet printer (hereinafter, referred to as a "printer") 1 as an example of a "recording apparatus" or a "liquid ejecting apparatus".

Herein, the liquid ejecting apparatus is not limited to an recording apparatus such as an ink jet type recording apparatus, a multifunction apparatus, a facsimile, or the like that ejects ink on a material to be recorded such as a recording paper from a recording head as a liquid ejecting head, and also includes an apparatus that ejects liquid corresponding to a specific application instead of the ink on a material to be ejected corresponding to the material to be recorded from a liquid ejecting head corresponding to the recording head to adhere the liquid on the material to be ejected.

Furthermore, beside the recording head, the liquid ejecting head includes a color material ejecting head used for manufacturing a color filter for a liquid crystal display or the like, an electrode material (conductive paste) ejecting head used for forming electrodes for an organic EL display, a field emitting display (FED), or the like, a living organic material ejecting head used for manufacturing biochips, a sample ejecting head for ejecting a sample as a precision pipette, and the like.

As shown in FIG. 1, the printer 1 is equipped with a feed unit 10, a transport unit 70, a recording unit 80, and a discharge unit not shown. The feed unit 10 includes a pickup unit 20, a sub separation unit 30, and a main separation unit 40. The pickup unit 20 is provided so that a paper P placed on a cassette 14 can be picked up and transported at a downstream side in a transport direction.

Specifically, the pickup unit 20 includes a pickup roller 21 that is driven by the power of a feed motor 91 that is an example of a driving source, and an arm 22 that holds the pickup roller 21 and is slid about an arm shaft 23 as a supporting point. The pickup roller 21 is biased in an approaching direction to the paper P by not shown bias means. Further, the arm 22 can be slid and the pickup roller 21 can be moved in a direction to separate from the placed paper P by pickup retracting means not shown. The operation is so called a pickup and release operation.

The sub separation unit 30 includes a bank separation unit 31 by which so called a bank separation is performed. The bank separation will be described below.

Furthermore, the main separation unit 40 is provided at the downstream side of the sub separation unit 31 in the transport direction. The main separation unit 40 includes so called a retard roller 41 that rotates with a predetermined load. The retard roller 41 is provided to form a pair with an intermediate roller 50 that is driven by the power of the feed motor 91. The retard roller 41 can be moved to be brought into contact with and separated from the intermediate driving roller 50 by a slide mechanism 43 (see FIG. 5). Specifically, the slide mechanism 43 is configured so that the retard roller 41 is held by a retard holder 42 (see FIG. 5) and the slide mechanism 43 is slid around a slide shaft 46 (see FIG. 5) as a supporting point.

Then, an end of a bias spring 47 (see FIG. 5) is engaged with a base unit 2, and the other end of the bias spring 47 is engaged with a free end side of the retard holder 42. Accordingly, the retard roller 41 can be biased in an approaching direction to the intermediate driving roller 50. Further, the slide mechanism 43 includes a cam 45 that is driven by a power a separation motor 92 as means for moving the retard roller 41 to separate from the intermediate driving roller 50 against the bias force of the bias spring 47. The cam 45 engages with a convex not shown of the retard holder 42 to constitute a groove cam mechanism. The cam 45 is provided so that the retard roller 41 can be moved to separate from the intermediate driving roller 50 via the retard holder 42.

Further, a first assist roller 48 that is driven to rotate is provided between the bank separation unit 31 and the retard roller 41. The first assist roller 48 is provided so that a tip of the paper P passed through the bank separation unit 31 can be smoothly guided to a nip point N between the retard roller 41 and the intermediate driving roller 50.

Furthermore, paper tip regulation ribs 60, 60 (see FIG. 9) described below are provided at the downstream side of the nip point N between the retard roller 41 and the intermediate driving roller 50 in the transport direction.

A second assist roller 51 rotatably held by the base unit 2 is provided to make contact with the intermediate driving roller 50 at the further downstream side in the transport direction. A third assist roller 52 is rotatably provided at the further downstream side in the transport direction.

Herein, a feed pathway of the paper P is formed in a U character shape from the pickup unit 20 to the transport unit 70. Specifically, the feed pathway having a U character shape is constituted by a U character shape outside paper guide unit 11 for guiding the paper P from outside the U character shape, an inside paper guide unit 12 for guiding the paper P from inside, the bank separation unit 31, and a winding prevention unit 13 described below.

Accordingly, a friction resistance generated between the paper P and the U character shape outside paper guide unit 11 of the base unit 2 can be reduced by the first assist roller 48 to the third assist roller 52. Accordingly, the paper P can be smoothly transported to the transport unit 70 provided at the further downstream side in the transport direction.

The transport unit 70 includes a pair of transport rollers 71 for transporting the paper P. The pair of transport rollers 71 includes a transport driving roller 72 that is driven by the power of the transport motor 91, and a transport driven roller 73 that is driven to rotate. The transport driven roller 73 is rotatably held by a driven roller holder 74.

Further, the driven roller holder 74 presses the transport driven roller 73 against the transport driving roller 72 by bias means not shown. Further, a paper detector 75 for detecting presence or absence of the paper P is provided near an upstream side of the pair of transport rollers 71 in the transport direction Y. Specifically, the paper detector 75 includes a paper detecting lever 77 that can be slid and a sensor 76. Then, the paper detector 75 is turned on when an end of the paper detecting lever 77 is made contact with the paper P to be slid and the other end of the paper detecting lever 77 is separated from between a light emitting unit and a light receiving unit not shown of the sensor 76.

Further, the transport unit 70 is provided so as to be able to transport the paper P to the recording unit 80 provided at the downstream side in the transport direction.

Furthermore, the recording unit 80 includes a recording head 82 for ejecting ink on the paper P to perform recording, and a platen 81 opposing the recording head 82 for supporting the paper P from the lower side.

Then, the recorded paper P is discharged in a discharge tray (not shown) in front of the printer 1 by a discharge roller of the discharge unit not shown.

Next, the paper transporting operation will be described in detail.

As shown in FIG. 1, when picking up the topmost paper P1 with respect to the pickup roller 21 placed on the cassette 14, the control unit 90 slides the arm 22 so that the pickup roller 21 is made contact with the topmost paper P1. Then, the pickup roller 21 is rotated in a clockwise direction in FIG. 1 by driving an arm motor 93.

At this time, the pickup roller 21 is biased in the approaching direction to the paper P by the bias means not shown. Accordingly, a friction force is generated between the pickup roller 21 and the topmost paper P1, and a transport force for transporting the topmost paper P1 at the downstream side in the transport direction can be generated. Then, by the transport force, the topmost paper P1 begins to move at the downstream side in the transport direction. That is, the topmost paper P1 is picked up and transported at the downstream side.

Note that when a friction coefficient between the pickup roller 21 and the topmost paper P1 is $\mu 1$, a friction coefficient between the paper P and the paper P is $\mu 2$, and a friction coefficient between a pad 15 provided at a position opposing the pickup roller 21 at the base unit side and the paper P is $\mu 3$, friction coefficient $\mu 1$>friction coefficient $\mu 3$>friction coefficient $\mu 2$ is satisfied. Accordingly, a risk that a plurality of overlapped papers P are fed together so called double feed can be reduced.

Further, when the paper P is picked up, the retard roller 41 is made contact with the intermediate driving roller 50.

Figure 2:
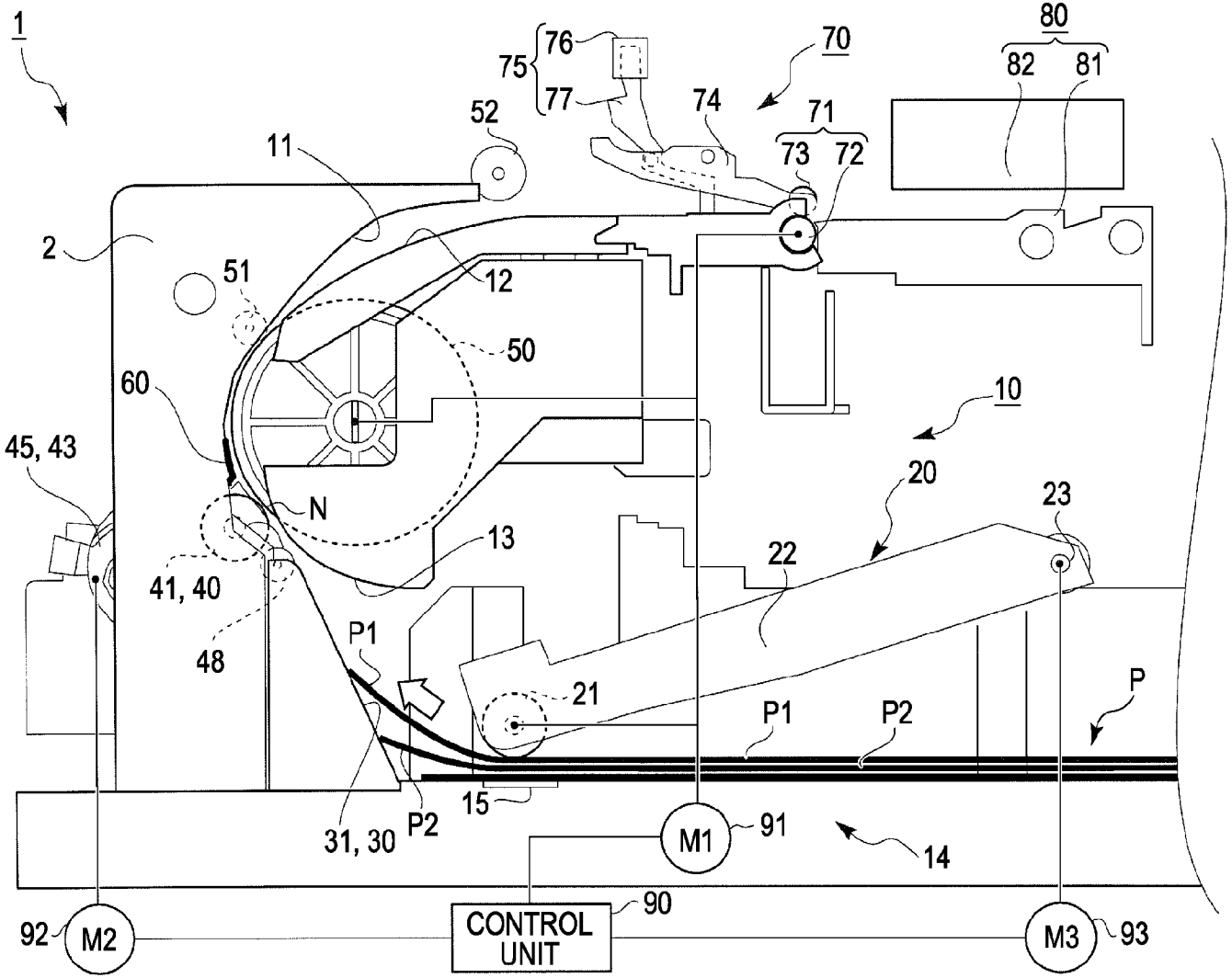
FIG. 2 is a side view showing a bank separation operation in the printer according to the invention.

FIG. 2 is a side view showing a bank separation operation in the printer according to the invention.

As shown in FIG. 2, the paper P picked up by the pickup roller 21 is transported at the downstream side in the transport direction. Then, the transported paper P enters the bank separation unit 31 as the sub separation unit 30.

Herein, there is a risk that a sending force is generated also to a following paper P2 by the friction coefficient $\mu 2$ between the topmost paper P1 and the following paper P2 and a bias force for biasing the pickup roller 21.

In this case, not only the topmost paper P1 but also the following paper P2 are transported at the downstream side in the transport direction by the pickup roller 21.

Consequently, the papers P are entered to the bank separation unit 31 provided to make an angle by which the posture of the tip of the paper P is displaced in order to separate the following paper P2 doubly fed from the topmost paper P1. Then, a trigger that the following paper P2 is stopped is made by striking the tip of the papers P to the bank separation unit 31. Further, a gap can be provided between the topmost paper P1 and the following paper P2. Accordingly the doubly fed following paper P2 can be separated from the topmost paper P1.

Figure 3:
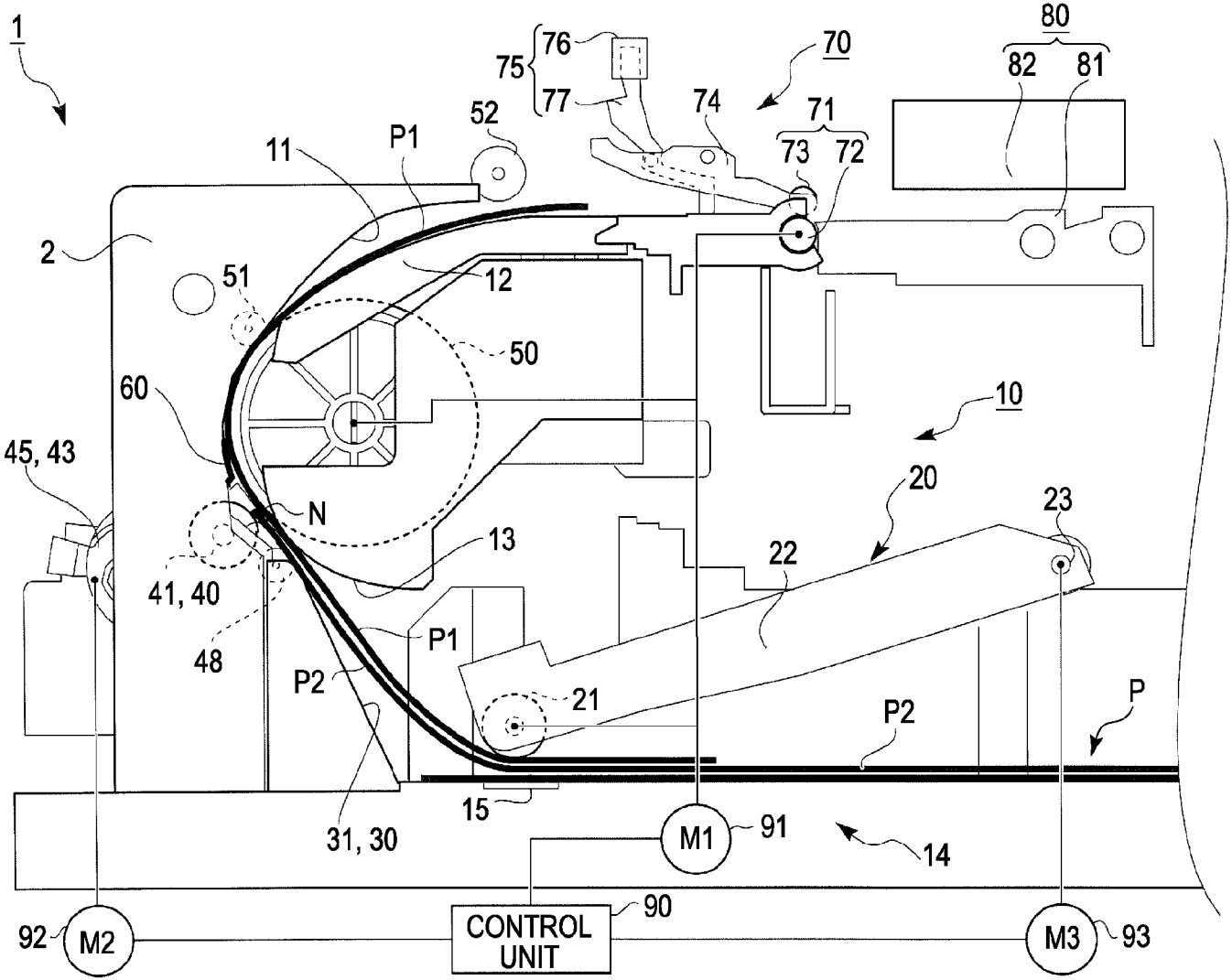
FIG. 3 is a side view showing a retard separation operation in the printer according to the invention.

FIG. 3 is a side view showing a retard separation operation in the printer according to the invention. As shown in FIG. 3, the paper P separated by the bank separation unit 31 is transported at the further downstream side in the transport direction by the pickup roller 21. Then, the paper P is transported to the nip point N at which the retard roller 41 that is the main separation unit 40 is made contact with the intermediate driving roller 50.

Note that in the embodiment, the sub separation unit 30 absolutely is sub separation means, so that there is a risk that a plurality of papers P are doubly fed to the main separation unit 40. Hereinafter, description will be made assuming that a plurality of papers P are doubly fed.

When the doubly fed papers P are transported to the nip point N, only the topmost paper P1 with respect to the intermediate driving roller 50 is directly made contact with the intermediate driving roller 50. Further, the tip of the following paper P2 is made contact with the retard roller 41 that is rotated with a predetermined load.

Herein, when a friction coefficient between the intermediate driving roller 50 and the topmost paper P1 is $\mu 4$, a friction coefficient between the paper P and the paper P is $\mu 2$, and a friction coefficient between the retard roller 41 and the paper P is $\mu 5$, the relations of friction coefficient $\mu 4$>friction coefficient $\mu 2$, and friction coefficient $\mu 5$>friction coefficient $\mu 2$ are satisfied.

Accordingly, a feeding force acting on the topmost paper P1 can be set larger than a feeding force acting on the following paper P2.

Herein, the load of the retard roller 41 is set larger than the feeding force acting on the following paper P2.

Accordingly, only the topmost paper P1 can be transported at the downstream side in the transport direction by rotating the intermediate driving roller 50 in the clockwise direction in FIG. 3.

To be more specific, the tip of the following paper P2 is held at the nip point N by the load of the retard roller 41, and a slip can be generated between the topmost paper P1 and the following paper P2. Accordingly, the topmost paper P1 can be fed to separate from the following paper P2 at the downstream side in the transport direction. Then, the tip of the topmost paper P1 passes through the second assist roller 51 and reaches the third assist roller 52 while being guided by the U character shape outside paper guide unit 11 and the inside paper guide unit 12.

Figure 4:
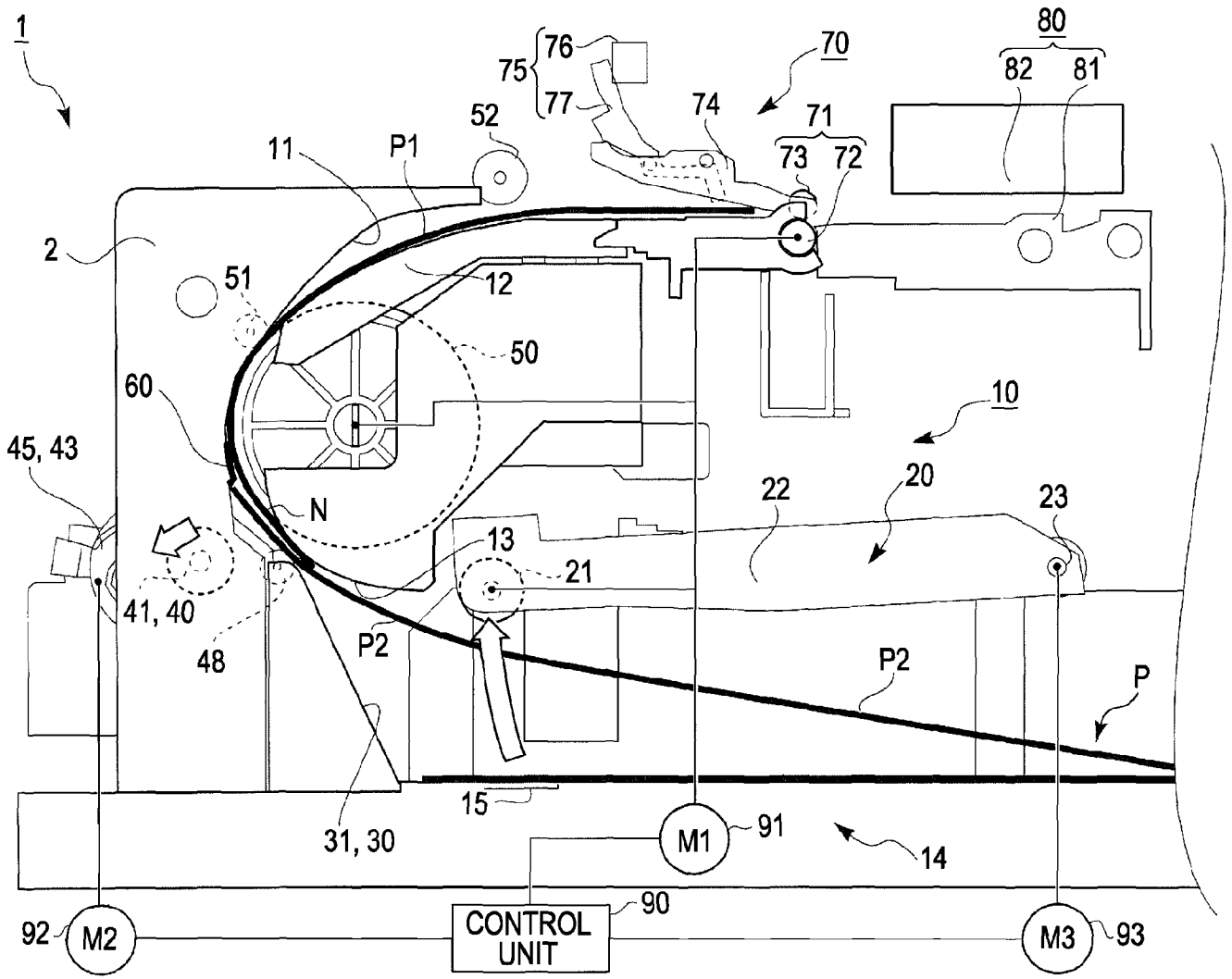
FIG. 4 is a side view showing a retard separation operation in the printer according to the invention.
Figure 5:
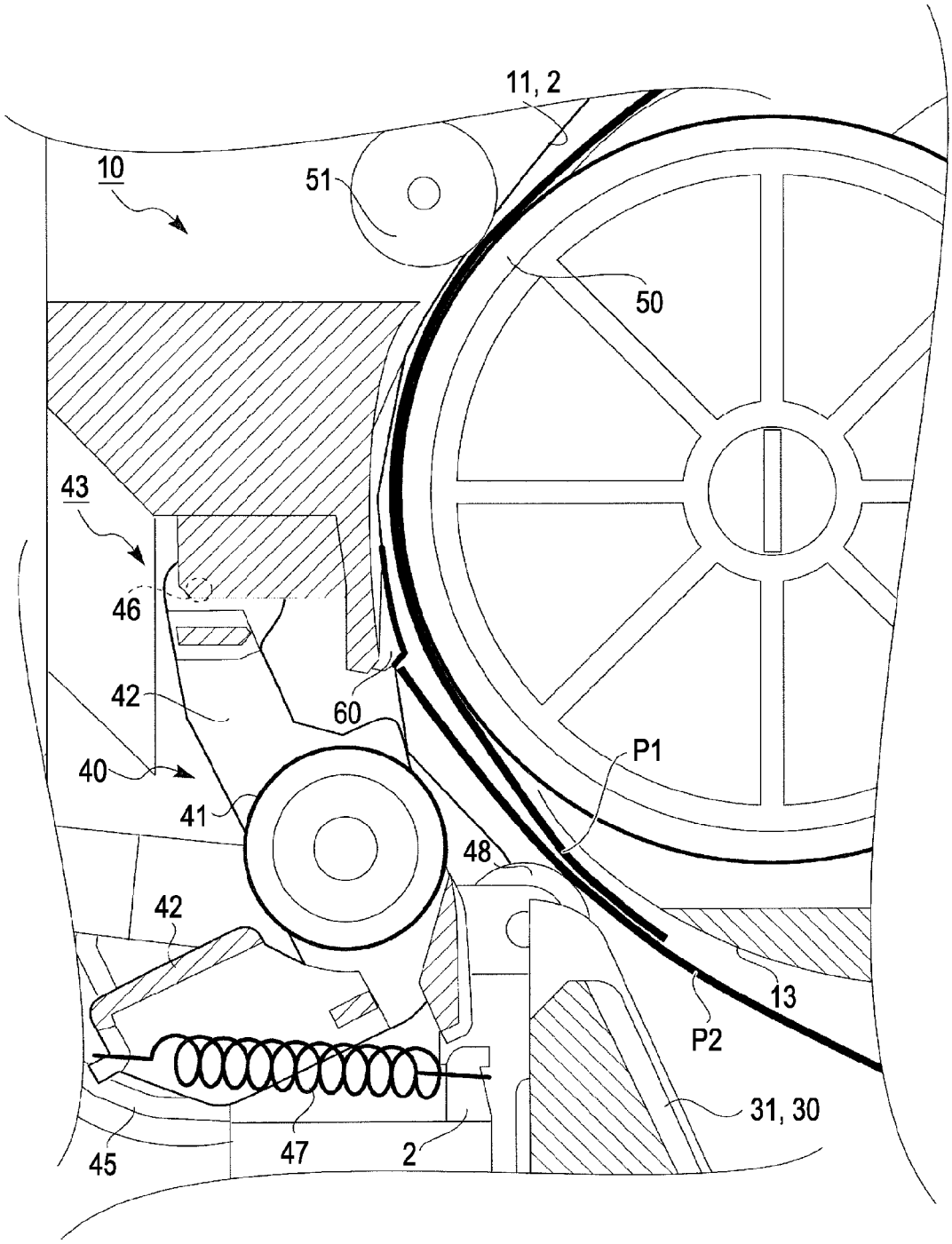
FIG. 5 is an enlarged sectional side view showing an enlarged appearance of the state of FIG. 4.

FIG. 4 is a side view showing a retard separation operation in the printer according to the invention. FIG. 5 is an enlarged sectional side view showing an enlarged appearance of the state of FIG. 4.

As shown in FIGS. 4 and 5, when the topmost paper P1 with respect to the intermediate driving roller 50 is further fed at the downstream side in the transport direction, the tip of the topmost paper P1 is detected by the paper detector 75. Specifically, the tip of the topmost paper P1 is made contact with an end of the paper detection lever 77 to slide the paper detection lever 77. At this time, the other end of the paper detection lever 77 is withdrawn from between the light emitting unit and the light receiving unit of the sensor 73, so that the paper detector 75 becomes ON state.

When the paper detector 75 becomes ON state as a trigger, the control unit 90 moves the retard roller 41 to apart from the intermediate driving roller 50. Specifically, the cam 45 is rotated by the separation motor 92 to slide the retard holder 42 in a direction retracting from the intermediate roller 50 against the bias force of the bias spring 47.

Further, the control unit 90 drives the arm motor 93 to slide the arm 22 in a direction in which the pickup roller 21 is retracted from the paper P placed on the cassette 14 about the arm shaft 23 as a supporting point.

Note that the timing for beginning the separation movement of the retard roller 41 may be the time when the intermediate driving roller 50 and the pickup roller 21 are rotated for predetermined numbers.

When the retard roller 41 is moved to be separated, the topmost paper P1 is fed by the intermediate driving roller 50 and the second assist roller 51.

Further, when the pickup roller 21 is moved to be separated, a feeding force from the intermediate driving roller 50 and the pickup roller 21 is not directly acted on the following paper P2. Accordingly, the following paper P2 whose tip is held by the retard roller 41 is returned to the cassette 14 by the self weight.

However, the rear end of the preceding paper P1 that is the topmost paper being fed by the intermediate driving roller 50 and the tip of the following paper P2 that is the flowing paper whose tip has been held by the retard roller 41 are made contact with each other. Accordingly, a feeding force is indirectly acted on the following paper P2.

The paper tip regulation ribs 60, 60 each having a convex shape are provided at the downstream side of the nip point N between the intermediate driving roller 50 and the retard roller 41 of the U character shape outside paper guide unit 11 in the transport direction. Note that the paper tip regulation ribs 60, 60 are provided near the both sides of the retard roller 41 in the width direction X of the paper P (see FIG. 9).

Since the feed pathway is bent in a U character shape, when the retard roller 41 is moved to be separated, the tip of the following paper P2 is displaced at the side of the U character shape outside paper guide unit 11.

Accordingly, the paper tip regulation ribs 60, 60 are made contact with the tip of the following paper P2 after the retard roller 41 is moved to be separated, which makes it possible to regulate the displacement of the following paper P2 at the downstream side in the transport direction.

That is, it can be surely prevented that the following paper P2 is transported at the downstream side in the transport direction. As a result, it can be prevented that the following paper P2 is dragged to be fed by the preceding paper P1, so called dragging feeding can be prevented. The dragging feeding frequently occurs when the contact area between the following paper P2 and the preceding paper P1 is large, especially when the paper P whose size is large is fed. Specifically, the dragging feeding frequently occurs when the size of the paper is not less than A3 size. In other words, when the size is not more than A4, since the contact area is small, the possibility of the dragging feeding is little.

At this time, the deflection amount of the following paper P2 can be reduced by moving the pickup roller 21 so as to be separated. That is, the posture of the following paper P2 can be formed to be straight as far as possible. Accordingly, the tip of the following paper P2 can be struck to the paper tip regulation ribs 60, 60.

Further, the rear end of the preceding paper P1 is acted to push the tip of the following paper P2 at the side of the U character shape outside paper guide unit 11 that is the outside of the U character shape pathway. Accordingly, the tip of the following paper P2 can be aggressively made contact with the paper tip regulation ribs 60, 60.

As a result, dragging feeding can be surely prevented. That is, the dragging feeding can be prevented without providing so called a return lever provided in a conventional technique.

Further, the retard roller 41 can be moved to be separated at an earlier timing as compared with the conventional technique. As a result, so called backlash caused by the load of the retard roller 41 can be reduced at an early timing. For example, the separation movement of the retard roller 41 may be started when the tip of the topmost paper P1 reaches the second assist roller 51.

Figure 6:
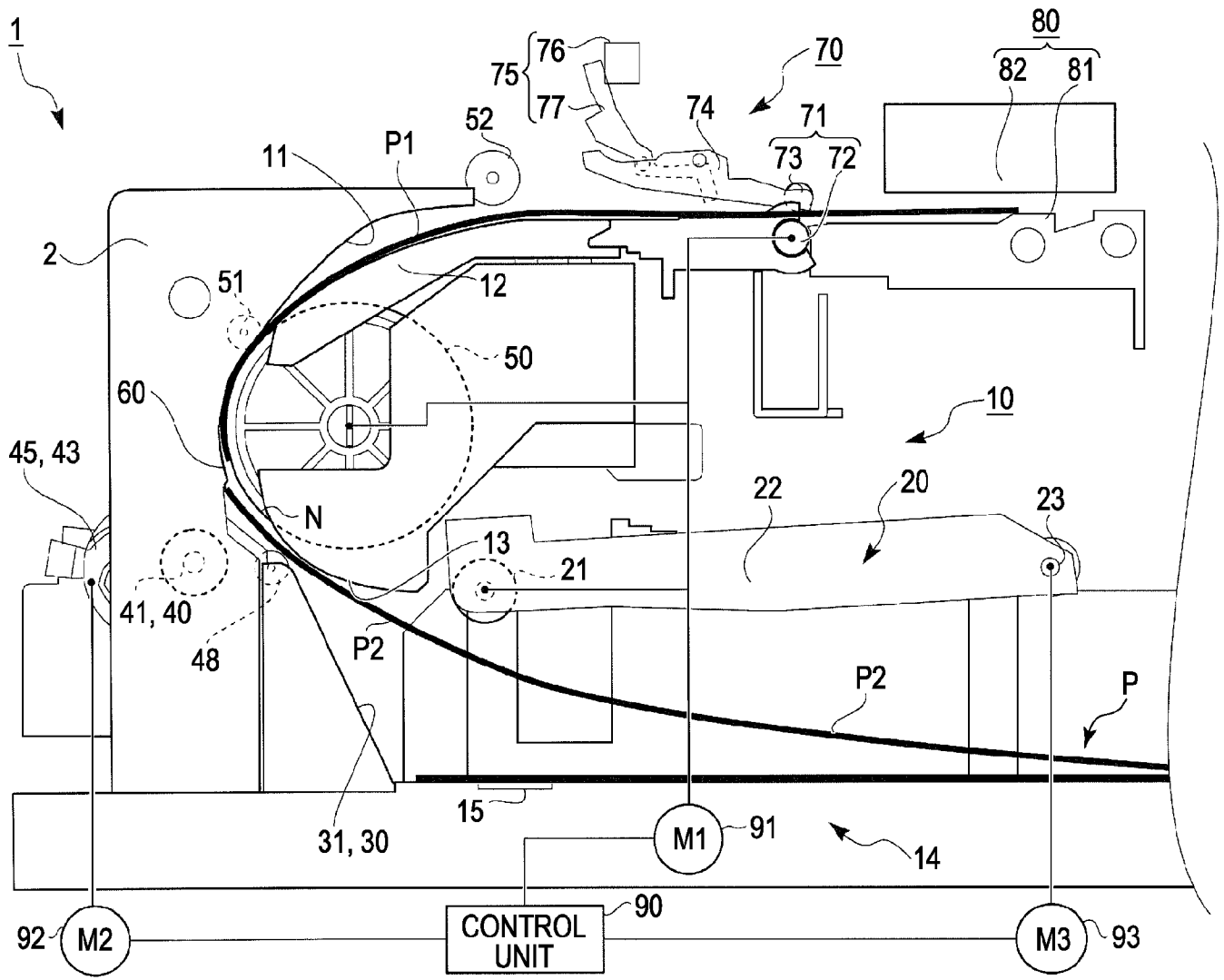
FIG. 6 is a side view showing a retard separation operation in the printer according to the invention.

FIG. 6 is a side view showing a retard separation operation in the printer according to the invention. As shown in FIG. 6, when the preceding paper P1 that is the topmost paper with respect to the intermediate driving roller 50 is further transported at the downstream side in the transport direction from the state of FIG. 5, the rear end of the preceding paper P1 passes through between the intermediate driving roller 50 and the retard roller 41.

Herein, the winding prevention unit 13 is provided inside the U character pathway. Specifically, the winding prevention unit 13 is provided to cover the intermediate driving roller 50 at the upstream side of the nip point N between the intermediate driving roller 50 and the retard roller 41 in the transport direction Y. Accordingly, the winding prevention unit 13 can prevent that the following paper P2 is made contact with the intermediate driving roller 50. As a result, there is no risk that the intermediate driving roller 50 directly acts a feeding force on the following paper P2.

Then, the tip of the preceding paper P1 is nipped by the pair of transport rollers 71. Then, skew correction is performed, and recording is performed on the preceding paper P1 by the recording unit 80 while being transported in the downstream side in the transport direction by the pair of transport rollers 71. Then, the paper P1 is discharged to the discharge tray (not shown) in front of the printer by the discharge unit not shown.

Figure 7:
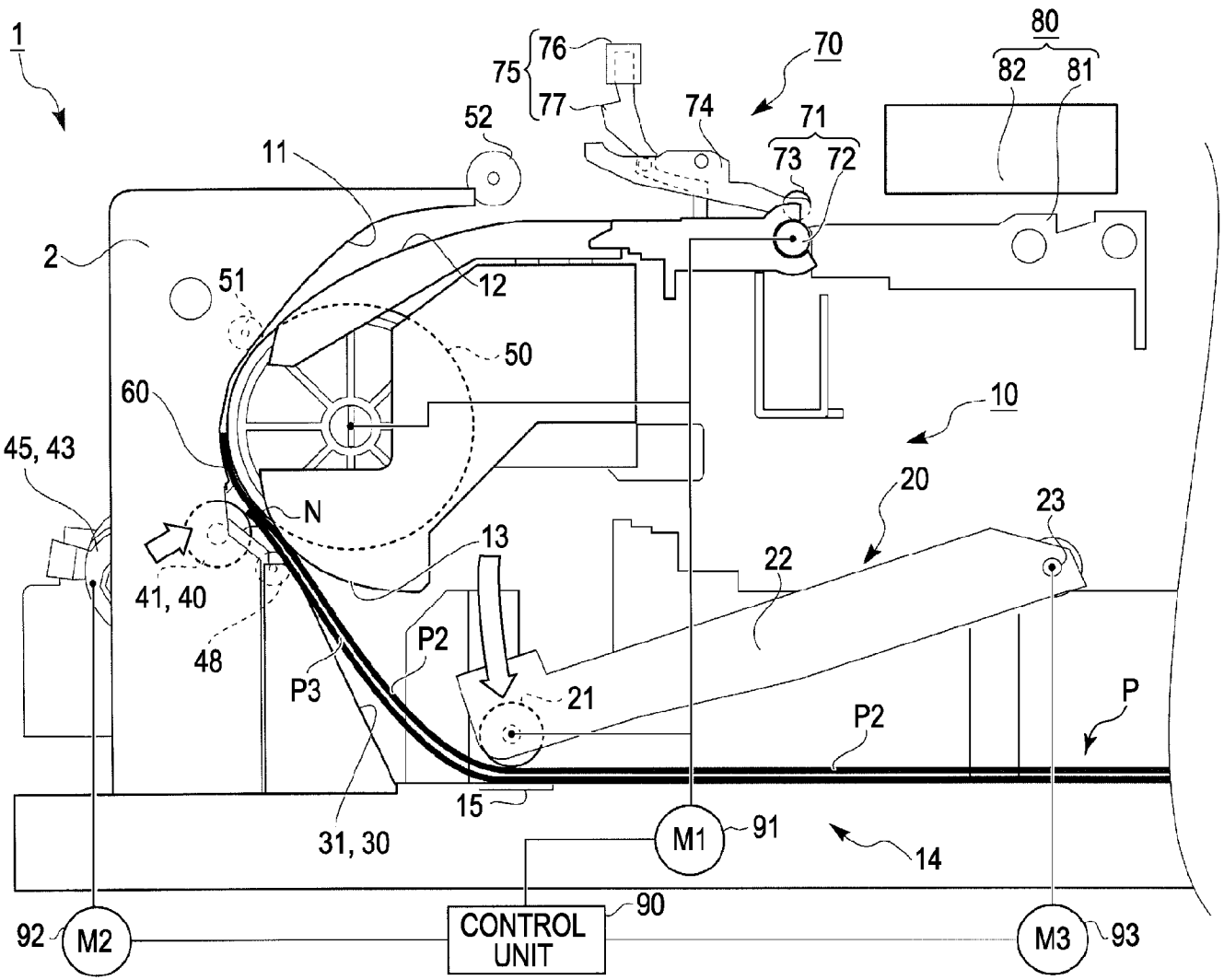
FIG. 7 is a side view showing an appearance when the following paper is picked up in the invention.
Figure 8:
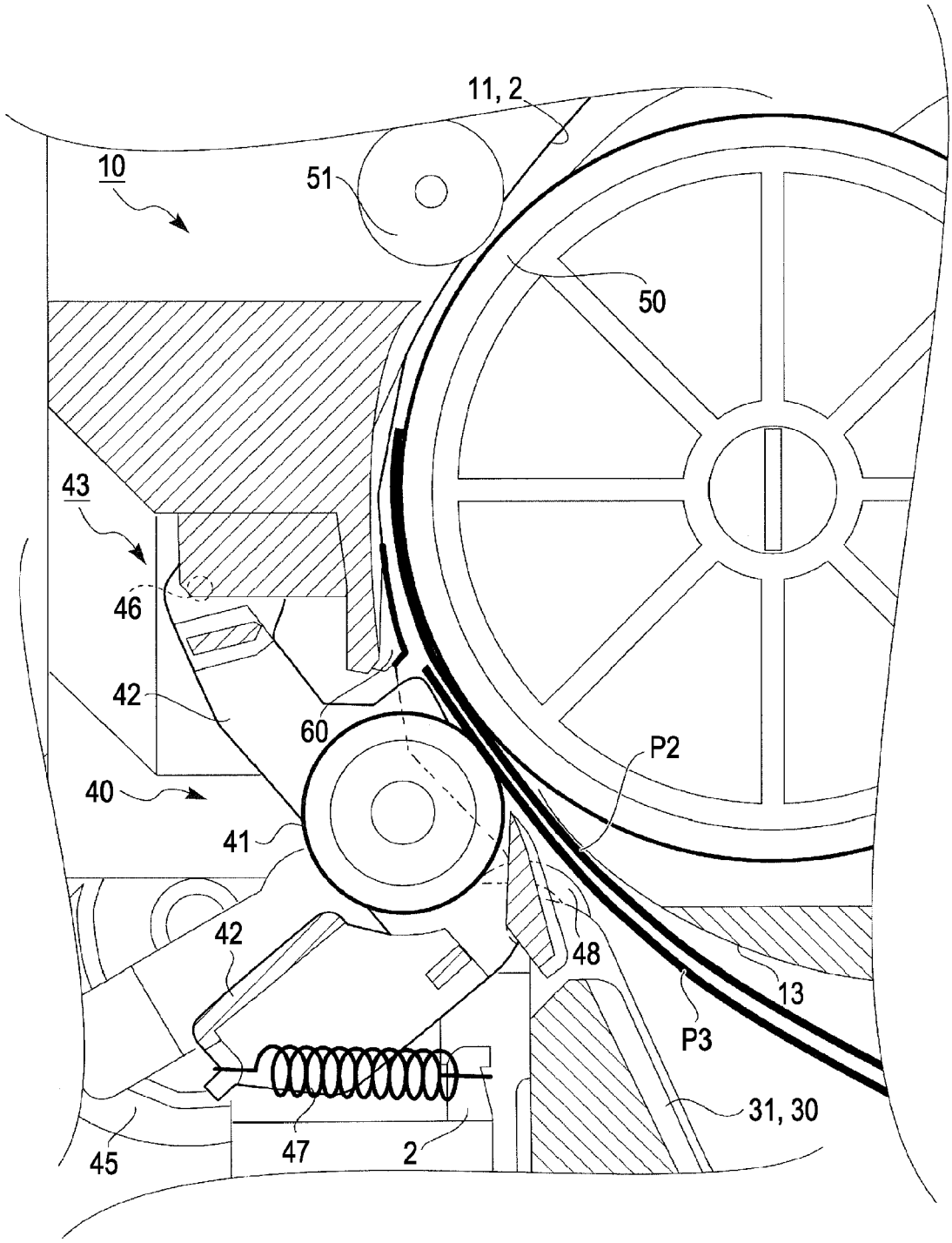
FIG. 8 is an enlarged sectional side view showing an enlarged appearance of the state of FIG. 7.

FIG. 7 is a side view showing an appearance when the following paper is picked up in the invention. FIG. 8 is an enlarged sectional side view showing an enlarged appearance of the state of FIG. 7.

As shown in FIGS. 7 and 8, the paper P can be sequentially fed after the preceding paper P1 is transported to the recording unit 80. Specifically, the control unit 90 moves the retard roller 41 to come close to the intermediate driving roller 50. To be more specific, the cam 45 is rotated by the separation motor 92, and the retard holder 42 is slid in an approaching direction to the intermediate driving roller 50 by the bias force of the bias spring 47.

Further, the control unit 90 drives the arm motor 93 to slide the arm 22 in a direction in which the pickup roller 21 comes close to the paper P placed on the cassette 14 about the arm shaft 23 as a supporting point.

At this time, the following paper P2 held by the paper tip regulation ribs 60, 60 are displaced at the intermediate driving roller side by the approaching movement of the retard roller 41. Then, the following paper P2 is nipped by the intermediate driving roller 50 and the retard roller 41. Accordingly, the tip of the following paper P2 is released from the paper tip regulation ribs 60, 60. In the state, the intermediate driving roller 50 and the pickup roller 21 are rotated in a clockwise direction in FIG. 7 as described above.

At this time, when the number of the following paper P2 held by the paper tip regulation ribs 60, 60 is one, one paper P2 is transported at the downstream side in the transport direction.

Further, when a plurality numbers of following papers P2, P3 . . . are held by the paper tip regulation ribs 60, 60, friction coefficient $\mu 4$>friction coefficient $\mu 2$, and friction coefficient $\mu 5$>friction coefficient $\mu 2$ are satisfied as described above.

Accordingly, a feeding force acted on the topmost paper P2 with respect to the intermediate driving roller 50 can be set larger than a feeding force acted on the following paper P3. That is, the following paper P3 can be separated by the retard roller 41, and only the topmost paper P2 can be transported at the downstream side in the transport direction. At this time, the tip of the topmost paper P2 is displaced at the intermediate driving roller side by the approaching movement of the retard roller as described above, so that there is no risk that the topmost paper P2 is regulated by the paper tip regulation ribs 60, 60.

Figure 9:
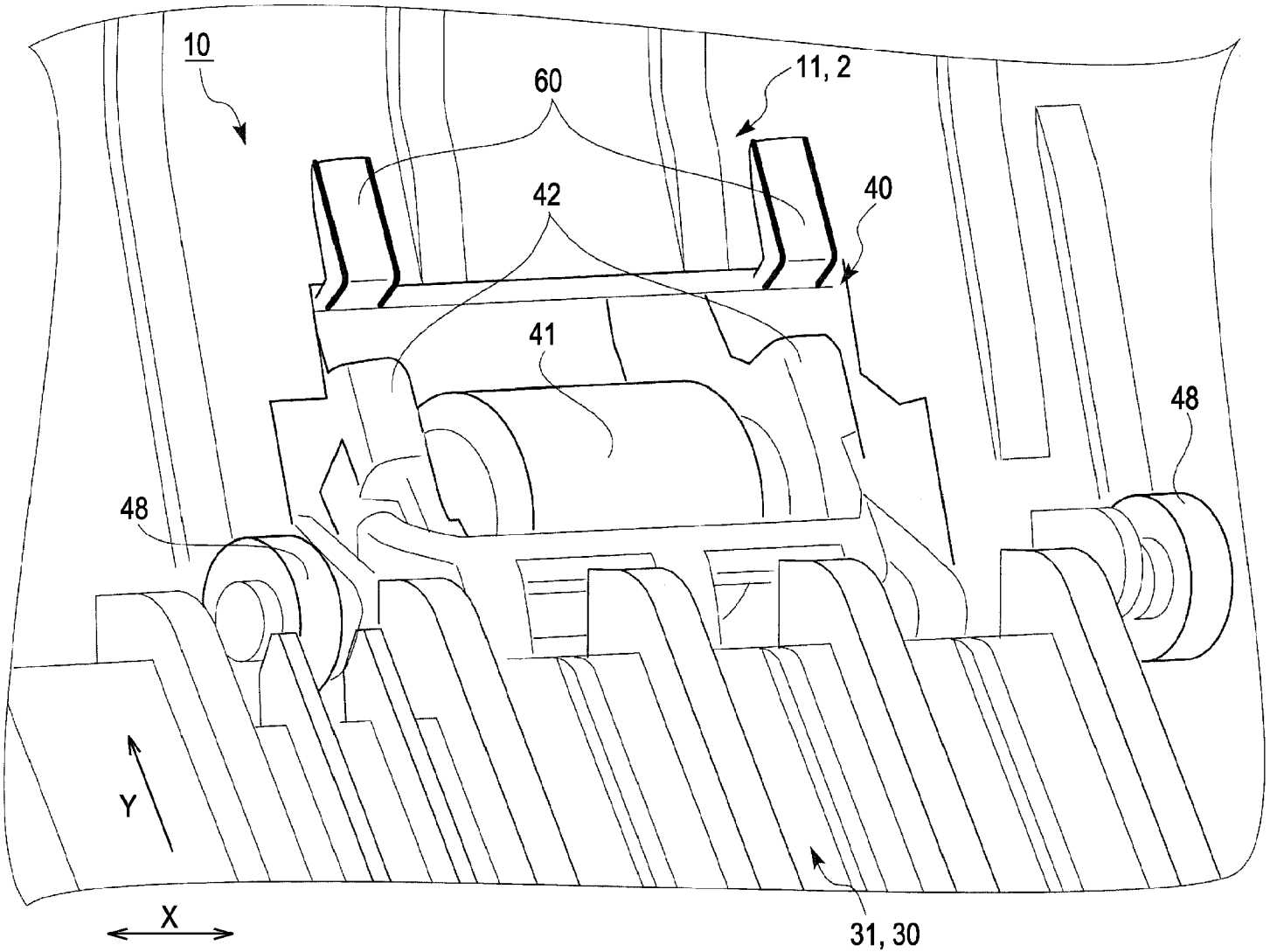
FIG. 9 is a perspective view showing paper tip regulation ribs according to the invention.
Figure 10:
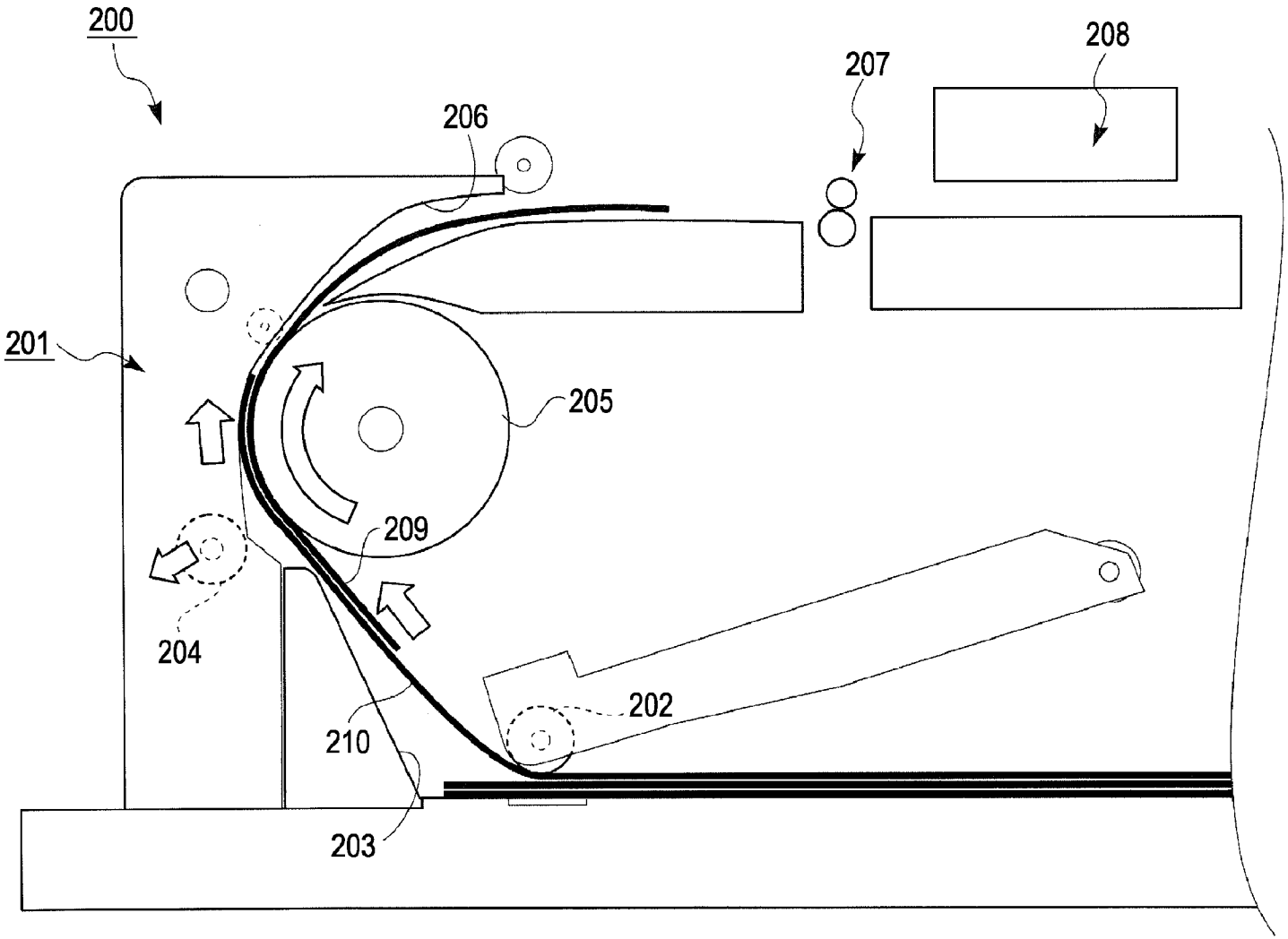
FIG. 10 is a side view showing an outline in a recording device according to a conventional technique.

FIG. 9 is a perspective view showing the paper tip regulation ribs 60, 60 according to the invention.

As shown in FIG. 9, the paper tip regulation ribs 60, 60 are provided near the downstream side of the nip point N between the retard roller 41 and the intermediate driving roller 50 in the transport direction Y. Further, the pair of paper tip regulation ribs 60, 60 are provide at the both side of the retard roller 41 in the width direction X of the paper P. Accordingly, in FIGS. 4 to 6, the tip of the following paper P2 can be made contact with the paper tip regulation ribs 60, 60 at two portions. As a result, there is no risk that the posture of the tip of the regulated following paper in the width direction X becomes unstable. That is, the posture of the tip of the following paper in the width direction X can be stable, and when the following paper in FIG. 8 is transported as the topmost paper P2, the topmost paper P2 can be transported with a good posture.

The feed unit 10 as the feeding device of the embodiment includes the pickup roller 21 for picking up the paper P as an example of a placed medium to be transported and transporting the medium at the downstream side in the transport direction, the U character shape outside paper guide unit 11, the inside paper guide unit 12, the winding prevention unit 13, and the bank separation unit 31 as the guide pathway for guiding the paper P transported by the pickup roller, the intermediate driving roller 50 that is driven by the power of the feed motor 91 as an example of a driving source and that transports the transported medium P at the further downstream side in the transport direction, the retard roller 41 that is moved to be brought into contact with and separated from the intermediate driving roller 50 and that is rotated with a predetermined load, the paper tip regulation ribs 60, 60 as the transported medium tip regulation convex provided at the side at which the retard roller 41 is provided in the U character shape outside paper guide unit 11, the inside paper guide unit 12, and the winding prevention unit 13 and at the downstream side of the nip point N between the retard roller 41 and the intermediate driving roller 50 in the transport direction, and the control unit 90 for moving the retard roller 41 to separate from the intermediate driving roller 50 after the papers P2 (P) doubly fed are separated by the retard roller 41, displacing a tip of the separated paper P2 which is the end of the separated paper P2 at the downstream side in the transport direction, and regulating that the tip of the separated paper P2 is moved at the downstream side in the transport direction by the paper tip regulation ribs 60, 60.

Further, in the embodiment, the transport pathway from the placed paper P to the nip point N between the retard roller 41 and the intermediate driving roller 50 is bent in side view to form a convex at the side at which the retard roller 41 is provided, the pickup roller 21 is provided to move to be brought into contact with and separated from the placed paper P, and the control unit 90 moves the pickup roller 21 in the direction to separate from the paper P when the retard roller 41 is moved to separate from the intermediate driving roller 50.

Furthermore, in the embodiment, the U character shape outside paper guide unit 11, the inside paper guide unit 12, and the winding prevention unit 13 as the guide pathway includes the winding prevention unit 13 as the contact prevention portion for preventing that the paper P is made contact with the intermediate driving roller 50 at the side at which the intermediate driving roller 50 is provided and at the upstream side of the nip point N in the transport direction.

Further, in the embodiment, the paper tip regulation ribs 60, 60 are provided at the both sides of the retard roller 41 in the width direction X of the paper P.

Furthermore, in the embodiment, the U character shape outside paper guide unit 11, the inside paper guide unit 12, the winding prevention unit 13, and the bank separation unit 31 are provided to form the feed pathway to have a U character shape.

Further, in the embodiment, the size of the paper P is not less than A3 size.

The printer 1 which is an example of the recording apparatus of the embodiment includes the feed unit 10 for picking up the paper P as an example of the placed medium to be recorded and feeding the paper P, the transport unit 70 for transporting the fed paper P at the downstream side in the transport direction, and the recording unit 80 for recording the transported paper P by the recording head 82.

It should be noted here that the invention is not limited to the embodiment, and various modifications can be made without departing from the scope of the invention described in Claims. It goes without saying that the modifications are also included in the scope of the invention.

What is claimed is:

1. A feeding device comprising:

a pickup roller for picking up a placed medium to be transported and transporting the medium at a downstream side in a transport direction;

a guide pathway for guiding the medium transported by the pickup roller;

a transport driving roller that is driven by a power of a driving source and that transports the transported medium at the further downstream side in the transport direction;

a retard roller that is moved to be brought into contact with and separated from the transport driving roller and that is rotated with a predetermined load;

a transported medium tip regulation convex provided at a side at which the retard roller is provided in the guide pathway and at the downstream side of a nip point between the retard roller and the transport driving roller in the transport direction; and a control unit for moving the retard roller to separate from the transport driving roller after the retard roller rotates with the predetermined load, displacing a tip of a subsequent medium at the downstream side in the transport direction, and causing the tip of the subsequent medium to be moved at the downstream side in the transport direction by causing the tip of the subsequent medium to come into contact with and be held by the transported medium tip regulation convex, such that the tip of the subsequent medium is held at the side at which the retard roller is provided in the guide pathway and at the downstream side of the nip point between the retard roller and the transport driving roller in the transport direction.

2. The feeding device according to claim 1, wherein a transport pathway from the placed medium to the nip point between the retard roller and the transport driving roller is bent in side view to form a convex at the side at which the retard roller is provided, the pickup roller is provided to move to be brought into contact with and separated from the placed medium, and the control unit moves the pickup roller in a direction to separate from the medium when the retard roller is moved to separate from the transport driving roller.

3. The feeding device according to claim 1, wherein the guide pathway includes a contact prevention portion for preventing that the medium is made contact with the transport driving roller at a side at which the transport driving roller is provided and at an upstream side of the nip point in the transport direction.

4. The feeding device according to claim 1, wherein the transported medium tip regulation convex is provided at the both sides of the retard roller in a width direction of the medium.

5. The feeding device according to claim 1, wherein the guide pathway has a U character shape.

6. The feeding device according to claim 1, wherein the size of the medium is not less than A3 size.

7. A recording apparatus comprising:

a feed unit for picking up a placed recording medium to be recorded and feeding the medium;

a transport unit for transporting the fed recording medium at a downstream side in a transport direction; and a recording unit for recording the transported recording medium by a recording head, wherein the feed unit is equipped with the feeding device according to claim 1.

* * * * *